US005244296A

United States Patent [19]

Jensen

[11] Patent Number: 5,244,296

[45] Date of Patent: Sep. 14, 1993

[54] KEYBOARD WRIST SUPPORT APPARATUS

[76] Inventor: Randall J. Jensen, 1348 W. Pecos Ave., Mesa, Ariz. 85202

[21] Appl. No.: 923,102

[22] Filed: Jul. 30, 1992

[51] Int. Cl.[5] ..... B41J 29/02

[52] U.S. Cl. ..... 400/715; D14/114; 248/918; 248/118.1; 400/691

[58] Field of Search ..... 400/715, 691; 248/118, 248/118.1, 118.3, 118.5, 918; D14/114

[56] References Cited

U.S. PATENT DOCUMENTS

| | | | |
|---|---|---|---|
| Re. 33,556 | 3/1991 | Berke | 211/69.1 |
| 3,300,250 | 1/1967 | Dollgener et al. | 297/411 |
| 4,481,556 | 11/1984 | Berke et al. | 400/715 |
| 4,482,063 | 11/1984 | Berke et al. | 400/715 |
| 4,482,064 | 11/1984 | Berke et al. | 211/69.1 |
| 4,621,781 | 11/1986 | Springer | 248/118 |
| 4,709,972 | 12/1987 | LaBudde et al. | 400/715 |
| 4,973,176 | 11/1990 | Dietrich | 400/715 |
| 4,976,407 | 12/1990 | Schwartz et al. | 400/715 |
| 5,040,757 | 8/1991 | Benaway | 248/118.3 |
| 5,050,826 | 9/1991 | Johnston | 248/118.3 |
| 5,056,743 | 10/1991 | Zwar et al. | 248/118 |
| 5,074,413 | 12/1991 | Ikuta et al. | 400/715 |
| 5,088,668 | 2/1992 | Grimm | 248/118.3 |
| 5,104,073 | 4/1992 | VanBeek et al. | 248/918 |

FOREIGN PATENT DOCUMENTS

| | | | |
|---|---|---|---|
| 2074948 | 11/1981 | United Kingdom | 400/715 |

OTHER PUBLICATIONS

Design News-"Wrist Rest", Jul. 22, 1991, p. 46.

The Arizona Republic-"User Friendly"-Ken Western, Nov. 3, 1991, pp. F1 and F2.

IO COMM, Prevents Carpal Tunnel Syndrome.

*Primary Examiner*—Edgar S. Burr

*Assistant Examiner*—Lynn D. Hendrickson

*Attorney, Agent, or Firm*—Jansson & Shupe, Ltd.

[57] ABSTRACT

A keyboard wrist support apparatus having an operator-proximal edge portion extending substantially toward the operator such that it maintains proper wrist angle during keyboard use. The invention includes a keyboard housing apparatus, as well as an overlay apparatus useable with a keyboard housing, and affords an efficient, economical approach to the problems associated with carpal tunnel syndrome. Through the use of this invention, proper wrist angle and degree of support are provided such that the incidence of carpal tunnel syndrome is substantially lessened.

16 Claims, 6 Drawing Sheets

KEYBOARD WRIST SUPPORT APPARATUS

FIELD OF THE INVENTION

This invention is related generally to keyboard apparatus and, more particularly, to wrist support systems incorporated therewith.

BACKGROUND OF THE INVENTION

Continuing development of electronic information systems coupled with the rapid growth of service-related industries has witnessed an increasing number of people employed in data entry or processing positions. The widespread full-time use of computers and related keyboard controls has spawned an alarming incidence of repetitive strain injuries (RSI's).

RSI's occur as a result of continual repetition of a particular motion over the course of a prolonged work period. Telephone directory operators, secretaries, airline reservation agents, and newspaper/publishing employees—generally anyone involved in full-time data entry or word processing—repeat certain physically-identical motions literally thousands of times per day.

Prominent among recognized RSI's is carpal tunnel syndrome (CTS). CTS is most closely-associated with keyboard use and invariably caused by use of the hands too often, too forcefully, or in the wrong position. Typically, improper chair or desk height and poor posture force individuals to type or otherwise use a keyboard in such a way as to require that their hands are bent back at the wrist. Constant repetition of motion in this position can and often does cause inflammation of the carpal ligaments at the base of the wrist. Subsequent compression and/or irritation of the median nerve and tendons can cause numbness, tingling or loss of sensation in the fingers, loss of muscle control or strength in the hands and fingers, as well as pain in the fingers, wrist, and into the shoulders. The symptoms and severity may vary from person to person.

Given the number of people employed in the service industries and the wide-spread occurrence of CTS, the health and economic impact is staggering. The Bureau of Labor Statistics has put the number of RSI's as approaching 100,000 reported cases per year, most of which are diagnosed as CTS. Conservative estimates place the average cost of treating a CTS patient as high as $15,000–$20,000, including the cost of medical treatment, ergonomic equipment, training, legal expenses and loss of productivity, as well as higher insurance premiums and higher costs for related employee benefits.

Because of the increasing costs associated with CTS, the search for an efficient, effective means by which to prevent such injuries has been ongoing concern in the art. Several approaches have been applied, each with certain limited success. One approach involves use of a wrist support systems positioned between the user and a keyboard. Such systems are available in a variety of configurations and with varying degrees of cushioned support. Another well-known approach incorporates the same support system in the context of an apparatus secured between the keyboard and the desk top on which it is placed. A recent, innovative approach is the development of an alternative keyboard apparatus which utilizes a pair of adjacent hand placement configurations which immobilize the user's hands and wrists, and involves activating key controls solely through finger movement.

However, the prior art has associated with it a number of significant problems and deficiencies. Most are related to the fact improper wrist angle is induced during keyboard use, and result from the designs and configurations of the apparatus currently used. (Improper wrist angle and that unequivocally associated with the incidence of CTS occurs when a keyboard user's hands are bent back at the wrist, toward the user when seated at a keyboard. Conversely, to avoid CTS, and for the purpose of this discussion, proper wrist angle may be defined as that shown when the user's wrists are either substantially unbent or where the hands of the user are bent forward and toward the keyboard as the user is seated before it.)

One major problem is that the free-standing support mechanisms are often costly, complex, and subject to mechanical or design failure. Position adjustment with respect to a particular keyboard may be achievable, but not without increased costs of manufacture and repair.

More affordable free-standing support apparatus are often characterized as being too soft or not providing the proper degree and angle of support. Furthermore, these systems are plagued by the fact that the supports move about when placed on a waxed or glass-covered desk top, such that readjustment of the support position is continually required during use.

The underlay-type apparatus addresses a number of the problems associated with free-standing support mechanisms, but creates others. Primary among these deficiencies is the fact that an apparatus of this sort is rarely compatible with a particular keyboard. Underlay systems which are adaptable to a particular keyboard are also prone to positioning problems. With others, while the weight of the keyboard and pressure thereon during use may hold the support mechanism in place, the angle and/or elevation provided is often ineffective by way of angle and support.

While some success has recently been claimed through use of the hand placement keyboard, any benefits derived therefrom are offset by the necessity of learning a new and entirely different typing/input methodology. Furthermore, the excessive cost and incompatibility of such devices with current word and date processing systems renders them impractical and unavailable for all but a very few of those seeking relief from CTS symptoms.

In summary, a considerable number of drawbacks and problems exist in the art relating to wrist support systems. There is a need for an improved apparatus, the use of which will prevent carpel tunnel syndrome and alleviate the costs associated therewith.

OBJECTS OF THE INVENTION

It is an object of this invention to provide an improved wrist support apparatus overcoming some of the problems and shortcomings of devices of the prior art.

Another object of this invention is to reduce the incidence of carpel tunnel syndrome and alleviate the symptoms associated therewith.

Another object of this invention is to provide an improved keyboard housing apparatus which is cost-effective, easily manufactured and assembled, and immune to mechanical failure.

Another object of this invention is to provide an improved keyboard housing apparatus which provides proper wrist support and angle, without movement during use.

Another object of this invention is to provide an improved keyboard housing apparatus which provides proper wrist support and angle without the need for a separate support accessory or mechanism.

These and other important objects will be apparent from the following descriptions and from the drawings.

SUMMARY OF THE INVENTION

This invention is an improved keyboard housing apparatus, including a preferred keyboard overlay. The invention overcomes certain well-known problems and deficiencies in the art, including those outlined above.

An important aspect of this invention is an improved wrist support mechanism which maintains proper wrist angle during keyboard use. The inventive support arrangement is configured in and integrated with the housing apparatus or overlay, and demonstrates the principle that a subtle, but distinct and unanticipated, structural variation can—and, in this case, does—have a significant impact on the results observed.

This invention is a keyboard housing apparatus of the type including an internal cavity and a substantially planar upper surface with openings through which keys may project. The apparatus terminates in an operator-proximal edge-portion, the improvement comprising the edge extending substantially horizontally toward the operator to an extent sufficient that it maintains proper wrist angle during keyboard use.

In preferred embodiments, the operator-proximal edge-portion is elevated relative to the horizontal, extends substantially the entire length of the keyboard, and is substantially parallel to the upper surface. In highly preferred embodiments, the operator-proximal edge further comprises a tapered key-adjacent section to facilitate access to the keys.

This invention also includes an overlay apparatus of the type useful with a keyboard housing, including a substantially planar member having upper and lower surfaces, with opening means through which keys may project. It terminates at an operator-proximal edge-portion, the improvement comprising the portion extending substantially horizontally toward the operator to an extent sufficient such that it maintains proper wrist angle during keyboard use.

In preferred embodiments, the operator-proximal edge-portion is elevated relative to the horizontal, extends substantially the entire length of the overlay, and is substantially parallel to the planar member. In highly preferred embodiments, the overlay further comprises means to removably engage and secure the overlay to the housing during use. The securing means comprises first and second fasteners: preferably, a plurality of hooks as a first fastener on the lower surface of the overlay and a plurality of loops as a second fastener on the housing.

Likewise, in highly preferred embodiments, the elevated operator-proximal edge-portion further comprises means supporting the overlay to prevent movement during keyboard use. Preferably, the prevention means is a substantially downward continuation of the operator-proximal edge-portion. As with the housing apparatus of this invention, a highly preferred embodiment of the overlay further comprises a tapered key-adjacent section to facilitate access to the keys.

As already noted, a wrist support mechanism has certain advantages. This invention allows those advantages to be more fully realized. Each keyboard housing or apparatus ma be designed to provide the proper angle and degree of support required to substantially lessen the incidence of CTS. Concerns over compatibility among the large variety of keyboard products is alleviated, as is the usual trial and error method typically associated with the selection of a proper support system.

Because the support mechanism is integrated directly into either the housing or overlay apparatus of this invention, correct wrist angle required for the housing or overlay may be achieved without resort to costly free-standing accessory support systems of the prior art. Without a complex design or moving mechanical components, manufacturing and replacement expenses are relatively low. With a cost approximating that associated with keyboards currently used, the invention described herein provides a cost-effective means of CTS prevention and relief.

Unlike a free-standing support apparatus, the housing and overlay of this invention are designed and configured such that they move with respect to the keys during use. Interruptions to adjust support placement are eliminated, increasing workplace productivity and efficiency. Furthermore, because its support mechanism is secured relative to the keys, this invention—unlike free-standing supports—may be used anywhere in conjunction with portable typewriters and personal computers, including the popular notebook and lap-top models.

Rather than merely cushioning the wrist area, the support mechanisms described herein prevents improper wrist angle during keyboard use. The distinct and unique support configuration ensures the wrists conform to an angle whereby the palms are positioned toward the wrist and the keyboard thereunder. In such a way, a subtle but and unanticipated structural modification alleviates inflammation of the carpal ligaments, subsequent compression of the median nerve, and the resultant symptoms associated with carpal tunnel syndrome.

DETAILED DESCRIPTION OF THE PREFERRED EMBODIMENTS

Figure 1:
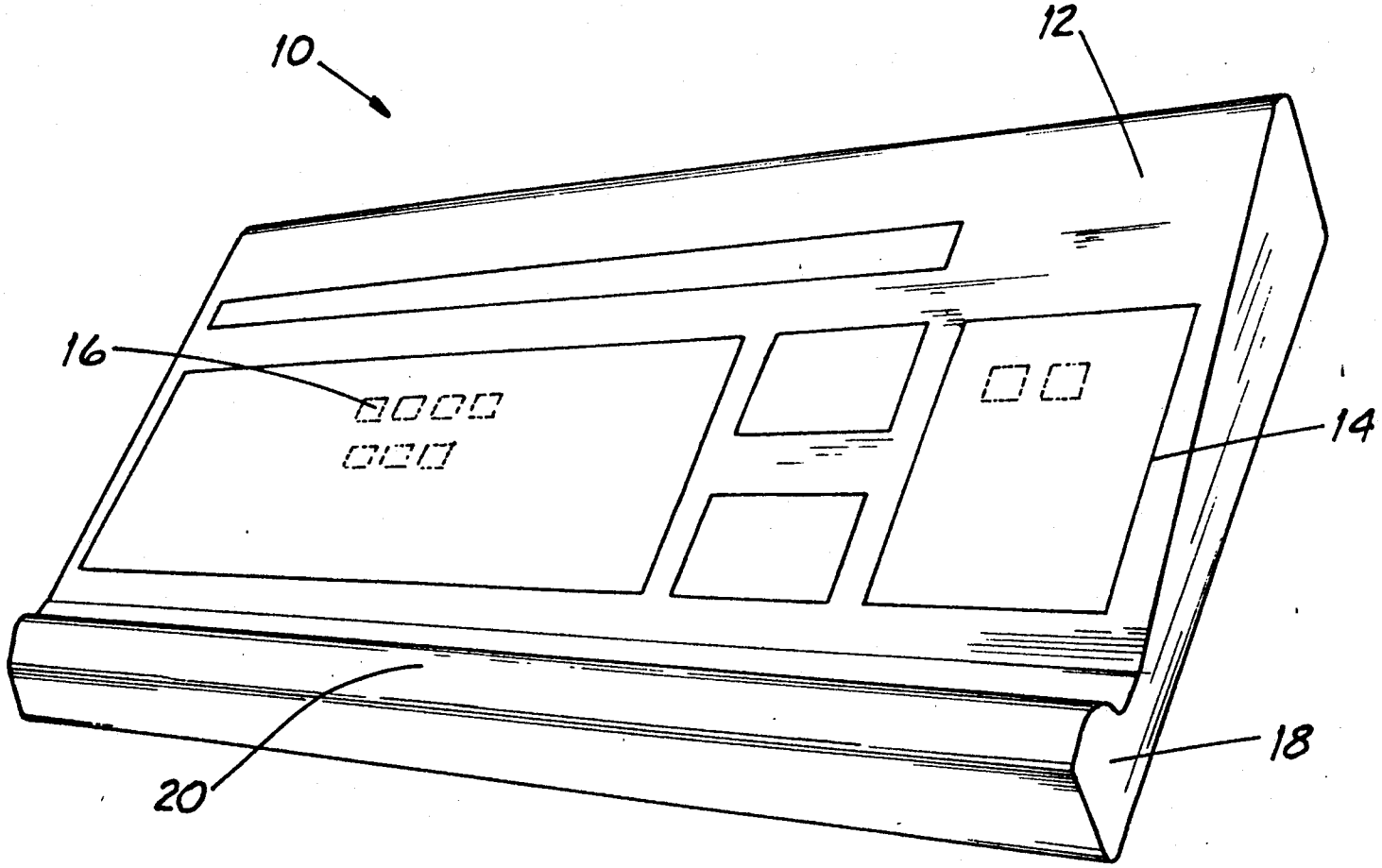
FIG. 1 is a full prospective view of a preferred improved keyboard housing apparatus in accordance with this invention.

The drawings illustrate an improved keyboard housing apparatus 10, a preferred embodiment of this invention. The apparatus includes a substantially planar surface 12 with openings 14 through which keys 16 may project, and terminates with an operator-proximal edge-portion 18.

Figure 2:
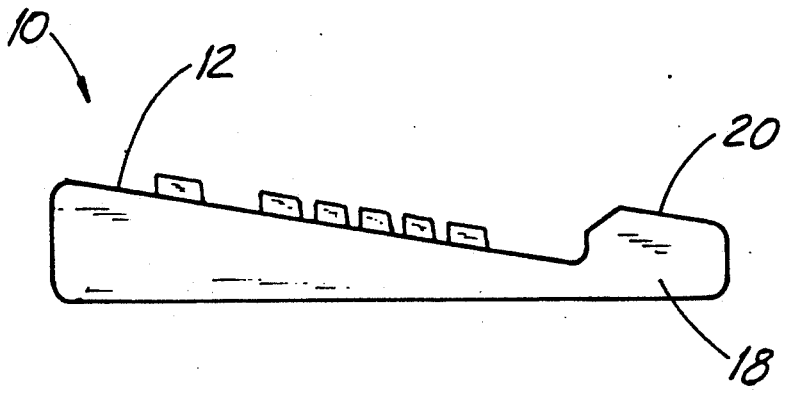
FIG. 2 is a side-edge view of a keyboard housing apparatus, showing the operator-proximal edge-portion with a preferred tapered key-adjacent section.
Figure 3:
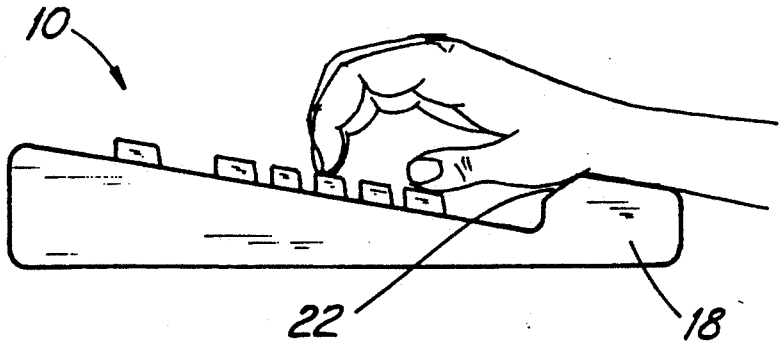
FIG. 3 is a side-edge view of a keyboard housing apparatus, showing wrist support and inducement of preferred wrist angle.
Figure 4:
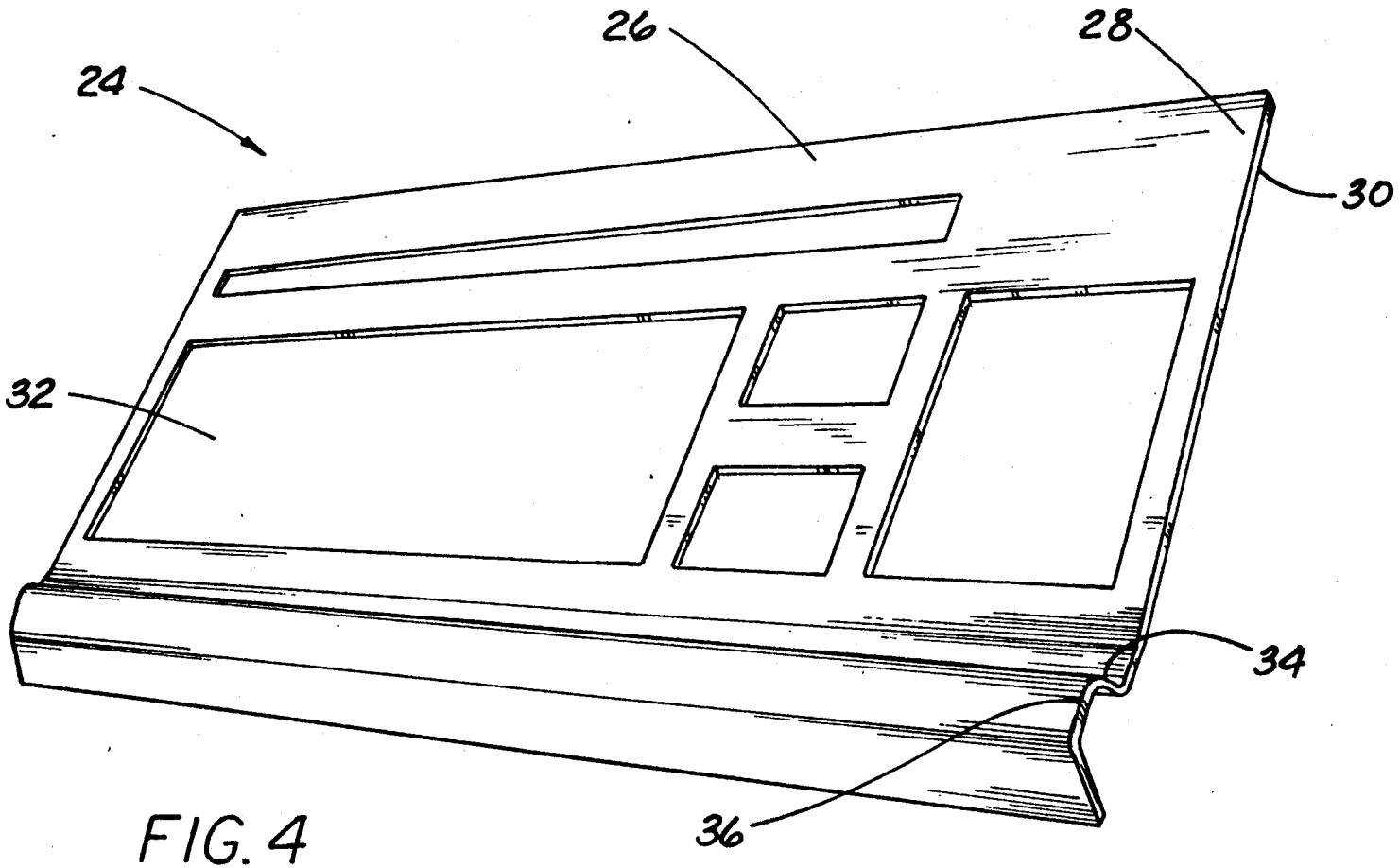
FIG. 4 is a full prospective view of a keyboard overlay apparatus in accordance with this invention.

As best shown in FIGS. 2 and 3, edge-portion 18 has an elevated region 20, parallel to planar surface 12, which provides and maintains proper wrist angle during keyboard use. Highly-preferred tapered key-adjacent section 22 facilitates access to the keys without relinquishing proper wrist angle and support.

FIGS. 4–7 illustrate an improved keyboard overlay apparatus 24, another preferred embodiment of this invention. The overlay apparatus includes planar member 26, which has an upper surface 28 and a lower surface 30. Openings 32 may be positioned and configured appropriately to permit keys to project therethrough. Member 26 terminates in an operator-proximal edge-portion which has an elevated region 36.

Figure 6:
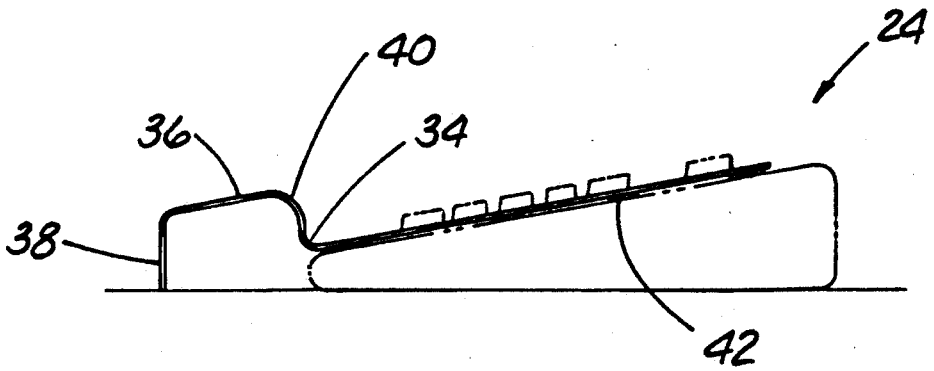
FIG. 6 is a side-edge view of a preferred keyboard overlay apparatus.
Figure 9:
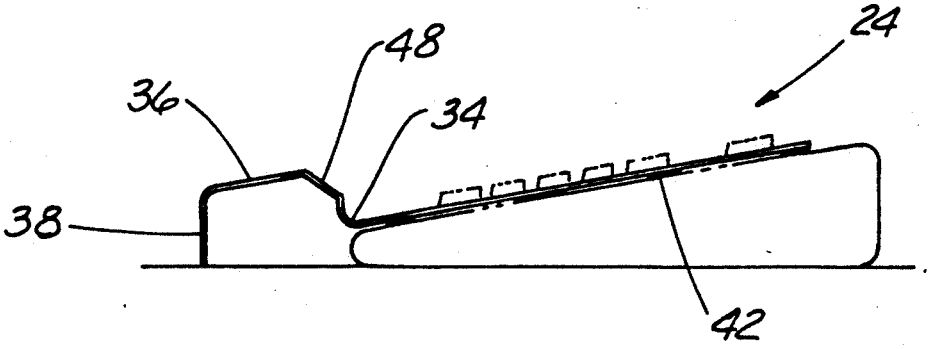
FIG. 9 is a side-edge view of an overlay apparatus showing the operator-proximal edge-portion with a preferred tapered key-adjacent section.

In preferred embodiments, as shown in FIG. 6, the elevated region 36 of edge-portion 34 further comprises support means 38, to prevent movement of the overlay with respect to the underlying keyboard housing, and key-adjacent section 40. In highly preferred embodiments, as shown in FIG. 9, tapered key-adjacent section 48 facilitates access to the keys without relinquishing proper wrist angle and support.

Figure 5:
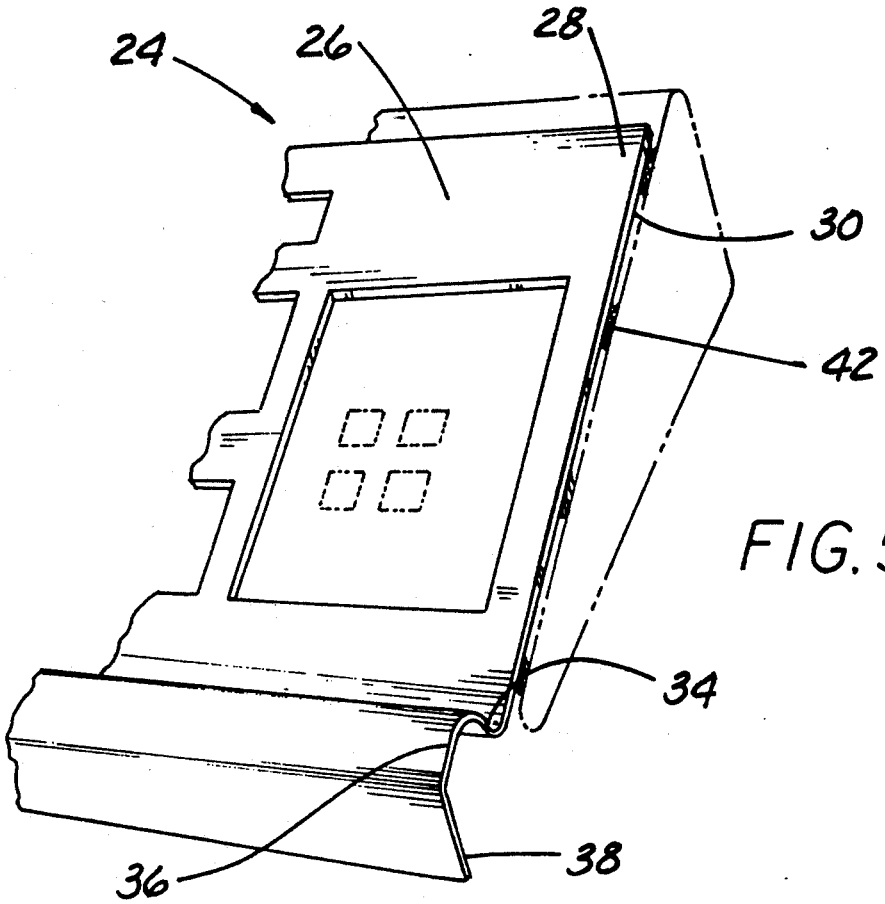
FIG. 5 is a fragmentary view of an overlay apparatus showing attachment to a conventional keyboard.
Figure 7:
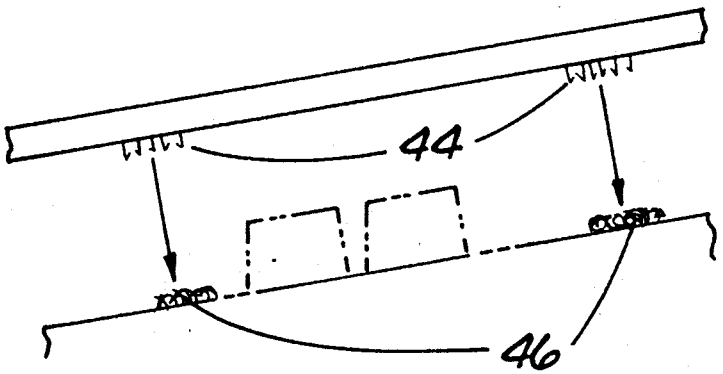
FIG. 7 is an enlarged, fragmentary view of a preferred overlay attachment.
Figure 8:
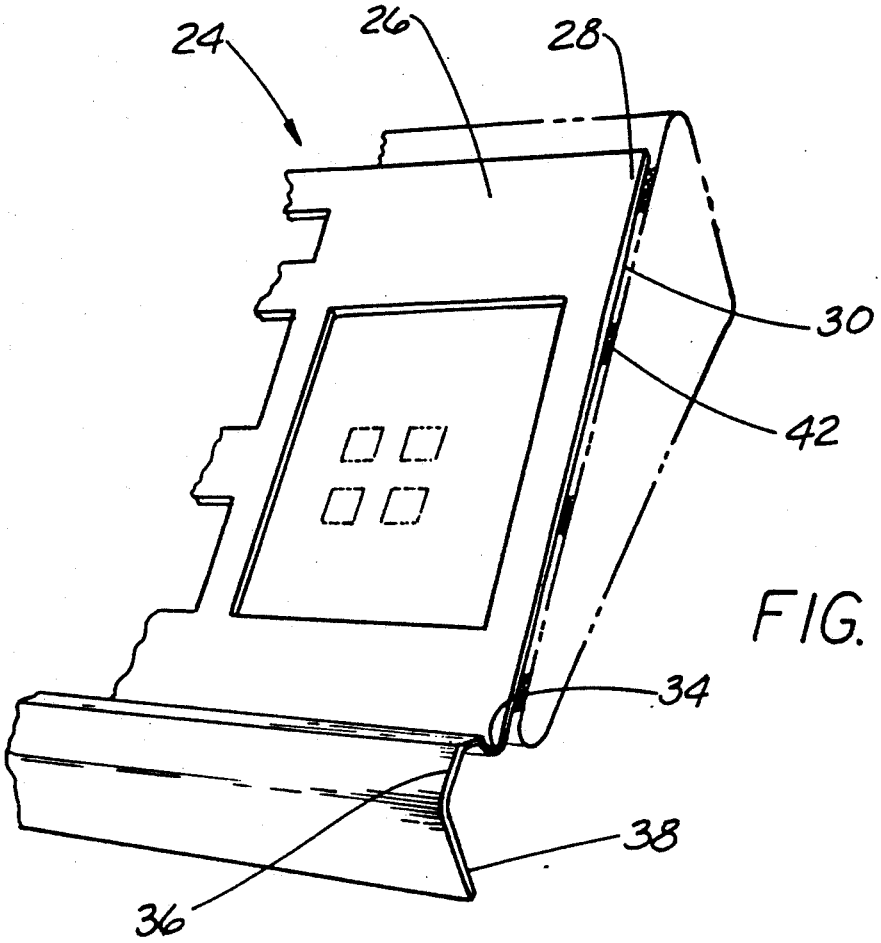
FIG. 8 is a fragmentary view of an overlay apparatus showing the operator-proximal edge-portion with a preferred tapered key-adjacent section and attachment of the overlay to a conventional keyboard.

In highly preferred embodiments, as best shown in FIGS. 5, 8, and 7, overlay 24 may be removably engaged to an underlying keyboard housing by securing means 42. Fastener 44 is a plurality of hooks on undersurface 30 of overlay 24, while fastener 46 is a corresponding plurality of loops affixed to the housing surface.

Keyboard housing 10 and overlay 24 may be made using a variety of materials. Preferred materials include rigid plastics with high-impact strength. Acceptable material choices for these embodiments, as well as for the various components thereof, will be apparent to those skilled in the art who are made aware of this invention.

While the principles of this invention have been described in connection with specific embodiments, it should be understood clearly that these descriptions are made only by way of example and are not intended to limit the scope of the invention. For example, both the housing and overlay embodiments of this invention may include cushioning, padding, or the like on those portions thereof directly in contact with the user's wrists. Likewise, it is contemplated that the principles of this invention may be applied to a wide variety of computer, typewriter, and keyboard accessories, including but not limited to portable lap top and notebook personal computers and mouse components.

I claim:

1. A keyboard housing apparatus of the type including an internal cavity and a substantially planar upper surface, having opening means through which keys project, and terminating in an operator-proximal edge-portion, the improvement comprising the edge-portion extending substantially horizontally toward the operator and having an elevated region which is elevated to a level substantially above the immediately adjacent keys, said elevation and extension toward the operator being to an extent sufficient to underlie the operator's wrists and to maintain proper wrist angle during keyboard use, the upper surface and edge portion being continuous, including the elevated region of the edge portion.

2. The apparatus of claim 1 wherein the operator-proximal edge-portion extends substantially the entire length of the keyboard and is substantially parallel to the upper surface.

3. The apparatus of claim 2 wherein the operator-proximal edge-portion further comprises a tapered key-adjacent section to facilitate downward access to said keys.

4. An overlay apparatus of the type usable with a keyboard housing including a substantially planar member having upper and lower surfaces, with opening means through which keys project, and terminating in an operator-proximal edge-portion, the improvement comprising the edge-portion extending substantially horizontally toward the operator and having an elevated region which is elevated to a level substantially above the immediately adjacent keys, said elevation and extension toward the operator being to an extent sufficient to underlie the operator's wrists and to maintain proper wrist angle during keyboard use, the overlay extending continuously across the edge-portion, including the elevated region thereof.

5. The apparatus of claim 4 wherein the elevated region of the operator-proximal edge-portion extends substantially the entire length of the overlay and is substantially parallel to the planar member.

6. The apparatus of claim 5 wherein the edge-portion further comprises means supporting the overlay to prevent movement with respect to the housing during use.

7. The apparatus of claim 6 wherein the prevention means is a substantially downward continuation of the operator-proximal edge-portion.

8. The apparatus of claim 4 further comprising means removably engaging the overlay to the housing to secure the overlay during use.

9. The apparatus of claim 8 wherein the securing means comprises first and second fasteners.

10. The apparatus of claim 9 wherein:

- the first fastener is a plurality of hooks on the lower surface of the overlay; and
- the second fastener is a plurality of loops on the housing.

11. The apparatus of claim 9 wherein the elevated region of the operator-proximal edge-portion extends substantially the entire length of the overlay and is substantially parallel to the planar member.

12. The apparatus of claim 11 wherein the edge-portion further comprises means supporting the overlay to prevent movement during keyboard use.

13. The apparatus of claim 12 wherein the prevention means is a substantially downward continuation of the operator-proximal edge-portion.

14. The apparatus of claim 4 wherein the operator-proximal edge-portion further comprises a tapered key-adjacent section to facilitate downward access to said keys.

15. The apparatus of claim 14 wherein the edge-portion further comprises means supporting the overlay to prevent movement with respect to the housing during use.

16. The apparatus of claim 15 wherein the prevention means is a substantially downward continuation of the operator-proximal edge-portion.

* * * * *